United States Patent [19]

Spraggins

[11] Patent Number: 4,679,610

[45] Date of Patent: Jul. 14, 1987

[54] MODULAR WINDOW INSERT WITH COLLAPSIBLE SHADE

[76] Inventor: Mike Spraggins, 13201 Stairock, San Antonio, Tex. 78248

[21] Appl. No.: 824,679

[22] Filed: Jan. 31, 1986

[51] Int. Cl.[4] ..... E06B 3/32

[52] U.S. Cl. ..... 160/107; 160/84 R

[58] Field of Search ..... 160/84 R, 105, 107, 160/172

[56] References Cited

U.S. PATENT DOCUMENTS

| | | | |
|---|---|---|---|
| 2,088,738 | 8/1937 | Fox | 160/107 |
| 2,269,579 | 1/1942 | Chilton | 160/107 X |
| 2,328,305 | 8/1943 | Stefano | 160/172 X |
| 2,631,339 | 3/1953 | Pratt | 160/107 X |
| 3,161,230 | 12/1964 | Knight | 160/107 |
| 3,253,644 | 5/1966 | Gotoh et al. | 160/107 |
| 4,202,395 | 5/1980 | Heck et al. | 160/84 R |
| 4,307,768 | 12/1981 | Anderson | 160/84 R |
| 4,342,355 | 8/1982 | Geller et al. | 160/331 |
| 4,586,289 | 5/1986 | Jaeger | 160/107 X |

*Primary Examiner*—Reinaldo P. Machado
*Assistant Examiner*—David M. Purol
*Attorney, Agent, or Firm*—Gunn, Lee & Jackson

[57] ABSTRACT

A modular, self-contained window insert made up of two panes of glass or impact resistant plastic which are secured within a frame which is sealed to prevent the entry of dust into the interior of the window unit. A shade in the form of a double accordian, collapsible sheet is placed within the window unit between the two panes of glass and can be moved upward or downward by use of a perimeter control mechanism secured to the frame.

8 Claims, 9 Drawing Figures

MODULAR WINDOW INSERT WITH COLLAPSIBLE SHADE

FIELD OF THE INVENTION

The present invention relates generally to the field of vehicle windows. Specifically, the present invention is directed to a self-contained, modular, double-paned window insert having a collapsible shade.

BACKGROUND OF THE INVENTION

It is well known that space onboard vehicles such as aircraft is at a premium. In the past, it has been difficult for designers of aircraft interiors to reach a compromise on a functional, yet attractive interior for an aircraft cabin while at the same time observing constraints regarding space and weight on board the aircraft. In particular, it is difficult to design an aircraft window which affords the passenger a pleasant view while also meeting the design requirements of the aircraft.

One of the most common designs of aircraft windows provides two panes of glass or impact-resistant plastic which are secured to the airframe. A molding, or "reveal," is then secured to the interior of the passenger compartment to cover the mounting hardware used to secure the window and to provide an aesthetically pleasing appearance for the passenger cabin. These window reveals typically include a window shade in the form of a rigid sheet of plastic which slides in vertical or horizontal tracks along opposing sides of the aircraft window. One of the difficulties with this particular arrangement is that the shade occupies a considerable amount of space when it is in the open position, since it must retreat into a compartment between the reveal and the airframe. Furthermore, grit and dust often accumulate in the guide tracks, thus making it difficult to move the shade between the open and closed position. Finally, this particular mounting arrangement is undesirable because the passenger must handle the shade directly to move it between the open and closed position. The shades used in such a system, therefore, eventually become smudged with grime and detract from the appearance of the aircraft interior.

Another approach for providing a shaded aircraft window involves the placement of a roller-type shade immediately above the window and between the airframe and the window reveal. This particular arrangement offers certain advantages over the sliding shade; in particular, it avoids the problem of dust collecting in the sliding tracks of the aforementioned design. However, it still has disadvantages with regard to efficiency of space, since the shade roller must be placed within the passenger compartment at a position which interferes with ventilation and lighting equipment.

Both of the above-mentioned window designs require that a number of components be attached to different portions of the airframes. The functional components, particularly those associated with the movement of the window shade, are, therefore, subject to misalignment as the airframe shifts in response to temperature differentials and load stresses during flight. Furthermore, both of the above-mentioned designs require a number of steps before installation of the window is complete. In essence, these prior designs require a custom installation which is both time-consuming and costly.

SUMMARY OF THE INVENTION

The modular, self-contained window insert of the present invention overcomes the difficulties of previous designs by providing an aircraft window which is economic to build, easy to install and which provides a collapsible shade requiring little storage space in the closed position. The window unit comprises two panes of glass or impact-resistant plastic which are secured within a frame which is sealed to prevent the entry of dust into the interior of the window unit. The window shade is formed from a flameproof, compressed polyester material. The shade is in the form of a double-accordion, collapsible sheet which provides excellent thermal and acoustical insulation when in the open position and which occupies very little storage space in the closed position.

The double-accordion shade is disposed within the sealed window unit between the two panes of glass and, therefore, is isolated from dirt and grime. The shade can be moved upward or downward by means of a perimeter control mechanism secured to the frame of the modular unit. This control mechanism can be actuated either manually or by an electric motor or pneumatically operated cylinder. The window shade control mechanism is totally suspended within the window unit and is maintenance-free in operation. Furthermore, the control system eliminates the need for guide tracks and is designed to prevent "creep" of the shade toward the closed position.

The invention modular window unit comprises an air gap between the two panes of glass, which gap serves as both an acoustic and thermal barrier. Additional acoustical and thermal insulation is provided by a plurality of baffles formed by the double accordion window shade when moved to its fully extended position.

In addition to the above-mentioned design features, the invention modular window unit offers numerous cost and installation advantages over previous designs. For example, the window can be assembled as a complete unit at a manufacturing facility and then shipped to a field facility for quick and easy installation into an aircraft. Since the window is installed as a complete modular unit, it can be independently shock mounted to the airframe, thus reducing the transmission of noise and vibration into the cabin. Also, since the unit is self-contained and the shade is collapsible within the frame, valuable space is conserved in the passenger compartment.

DETAILED DESCRIPTION OF THE PREFERRED EMBODIMENT

Figure 1:
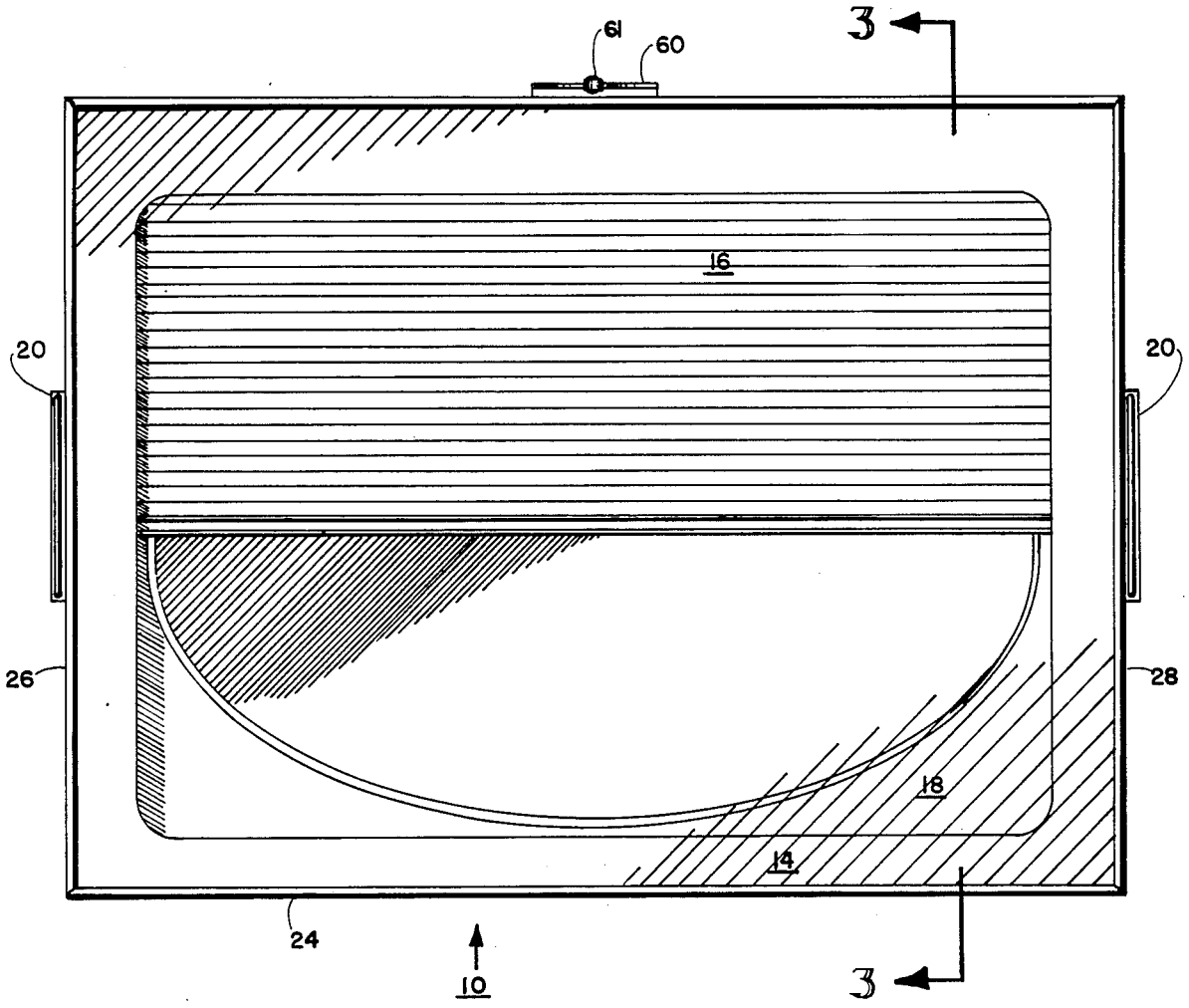
FIG. 1 is an elevational front view of the invention modular window insert showing the collapsible shade in a partially extended position.

Referring to FIG. 1, the modular window insert 10 of the present invention is shown with the collapsible shade 16 in the partially closed position. The structural relationship of the various components of the window insert 10 can be seen best by referring to FIG. 2. These components consist of an inner window pane assembly 12, a generally rectangular mask 14, a double accordion collapsible shade assembly 16 and an outer window reveal assembly 18 which contains as part thereof outer lens 62. Each of the above-mentioned components has a curvature, as can be seen in FIG. 3, which allows the window unit to conform to the contour of an aircraft frame when mounted therein.

The inner window pane 30 is secured within the window unit 10 by an inner frame assembly comprising upper and lower frame members 22 and 24, respectively, and left and right frame members 26 and 28, respectively. Details relating to the mounting of the inner pane 30 within the inner frame assembly can be seen generally by referring to FIG. 3*a*. Although FIG. 3*a* is a detailed partial cross-section of the mounting of the inner pane 30 in the lower frame member 24, it is to be understood that the discussion relating to this frame member is equally applicable to the upper frame member 22 and to the left and right side members 26 and 28, respectively, of the inner frame assembly.

Each of the inner frame members comprises a generally flat lower surface 33, a forward vertical lip 32 and a rearward C-shaped portion 34. A channel 35 extends the length of each of the frame members within the C-shaped portion 34. As can be seen in FIG. 3*a*, the inner window pane 30 is secured within the frame member by an elongated strip of rubber 36 which has a forward shoulder to provide a cushion to the edges of the inner window pane 30. The window pane 30 is thus received between the inner surface of the forward lip 32 and the forward vertical surface of the rubber strip 36. The inner window pane 30 can be secured within the frame by placing a plurality of spring clips 40 within a channel extending the length of the rubber strip 36. Each of the clips so inserted has a lower spherical tip 41 and a pair of spring clip arms 42 and 43, respectively. When inserted in the rubber strip 36, the spherical tip 41 is received in a complimentary circular channel 48 extending the length of the rubber strip 36 and the spring clip arms 42 and 43 are in contact with the inner surfaces of the passage 46 through which the spring clip is inserted.

Figure 4:
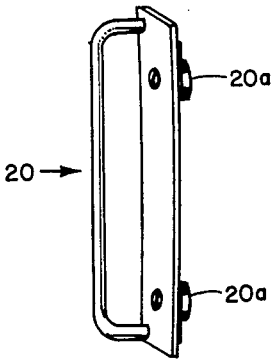
FIG. 4 is an elevational perspective view of the handle assembly used on versions of the invention window unit which are attached to aircraft emergency exits.

An alternate embodiment of the invention window insert comprises handles 20, shown in FIGS. 1 and 4, attached to inner frame members 26 and 28. Each of these handles has a plurality of threaded tubular members **20*a*** to allow the window assembly to be attached to an emergency exit of an aircraft.

Figure 2:
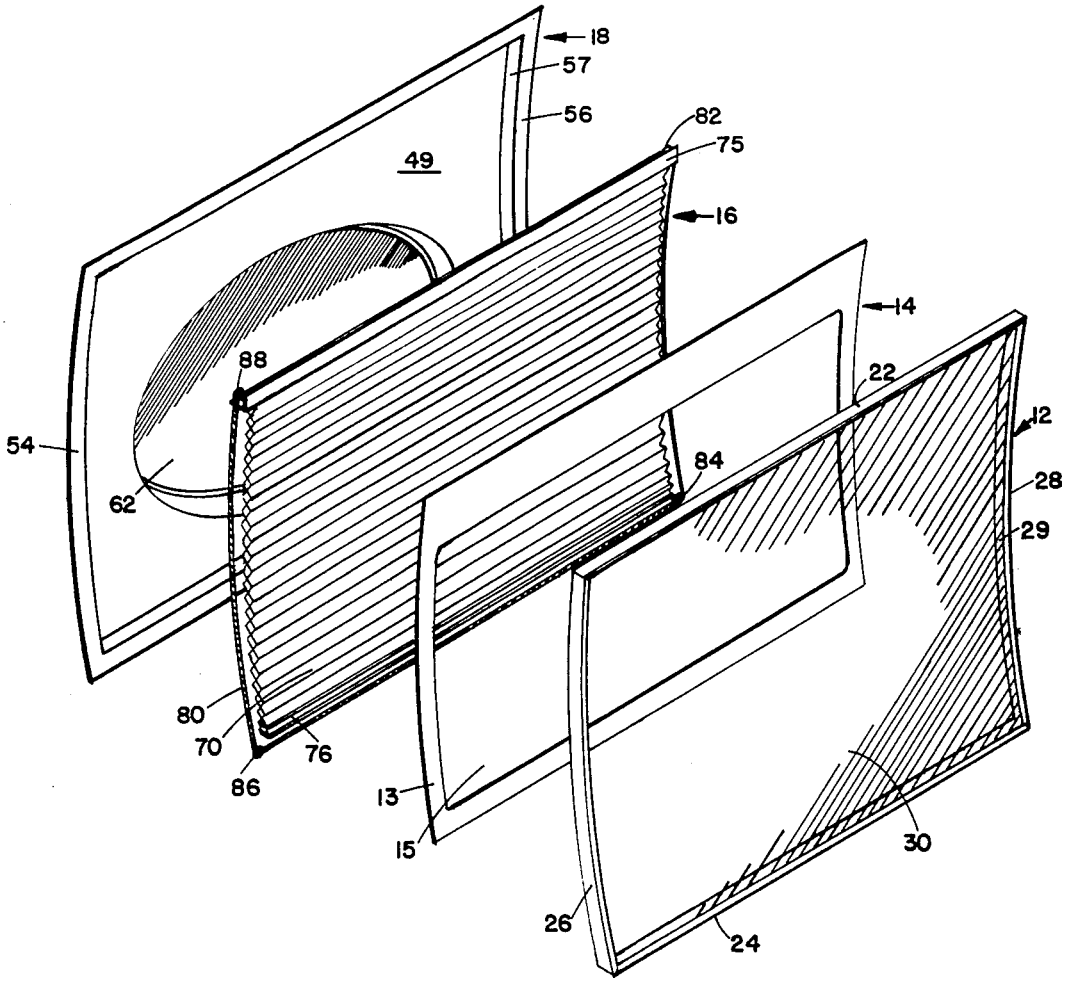
FIG. 2 is an exploded perspective view showing the individual components of the invention modular window insert.
Figure 3:
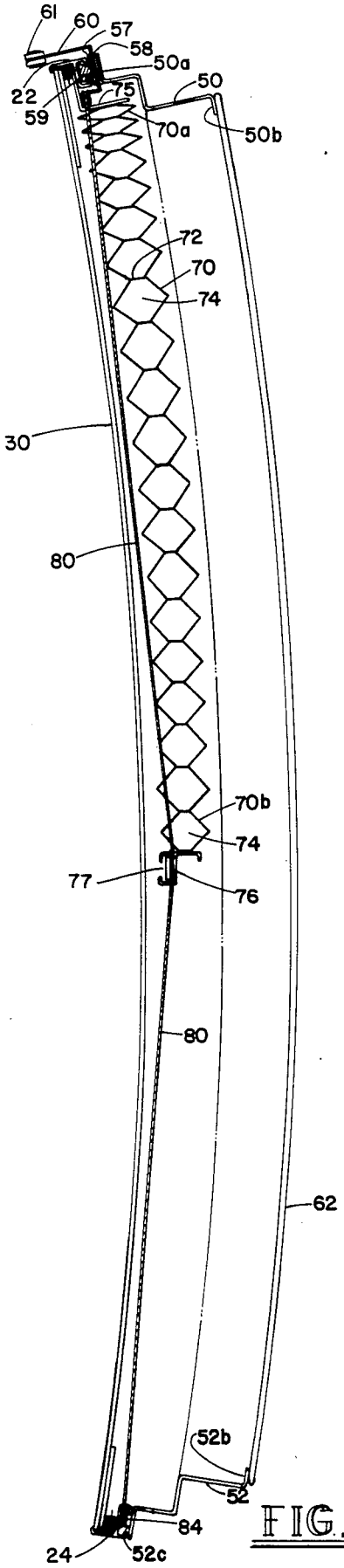
FIG. 3 is a sectional side view, taken along section lines 3—3 of FIG. 1, showing details relating to the window shade control system and the structure of the double accordion window shade.
Figure 3A:
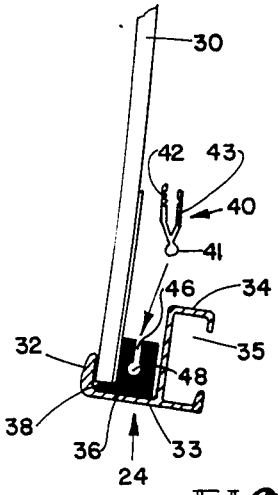
FIG. 3*a* is a partial cross-sectional detail view of the frame and seal assembly securing the inner window pane within the frame.

The outer frame of the modular window unit is defined by the outer window reveal assembly 18, shown in FIGS. 2 and 3, comprising an outer faceplate 49 which is molded from a resilient impact-resistant plastic material. The outer edges of the faceplate 49 comprise Z-shaped flanges, e.g., upper and lower flanges 50 and 52, respectively, and left and right flanges 54 and 56, respectively. Each of the Z-shaped flanges mentioned above has forward and rear vertical faces as represented in FIG. 3 by **50*a* and 50*b*, corresponding to flange member 50, and by 52*a* and 52*b* corresponding to flange member 52. The forward vertical faces, e.g. 50*a* and 52*a* of FIG. 3, of each of the flange members is attached to the rearward faces of the C-shaped rear portions of each of the inner frame members, thus providing a sealed perimeter for the window unit to prevent the entry of dust into the inner compartment of the window. A central portion of the seam between the upper members 22 and 50, respectively, of the inner and outer frames is provided with a closely spaced channel to receive the collapsible shade actuator handle 60, which will be discussed in greater detail hereinbelow. The opposing faces of the upper frame members 22 and 50 are provided with a dust seal comprised of elongated strips 56 and 58 of felt-like material to provide a barrier to the entry of foreign matter to the interior of the window unit. The outer window reveal 49 can be adapted to fit a wide variety of aircraft by changing the shape of the outer lens bezel 50*b***.

Figure 5A:
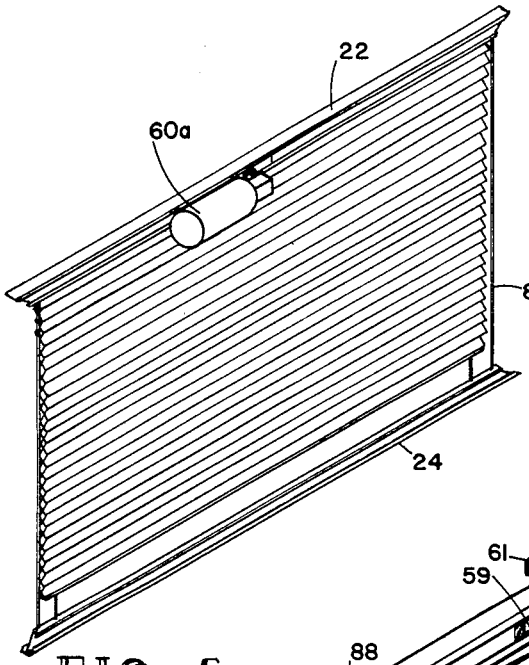
FIG. 5*a* is a perspective view of the collapsible double accordion shade of the invention window unit showing details relating to an alternate embodiment actuator for controlling the position of the window shade.
Figure 5:
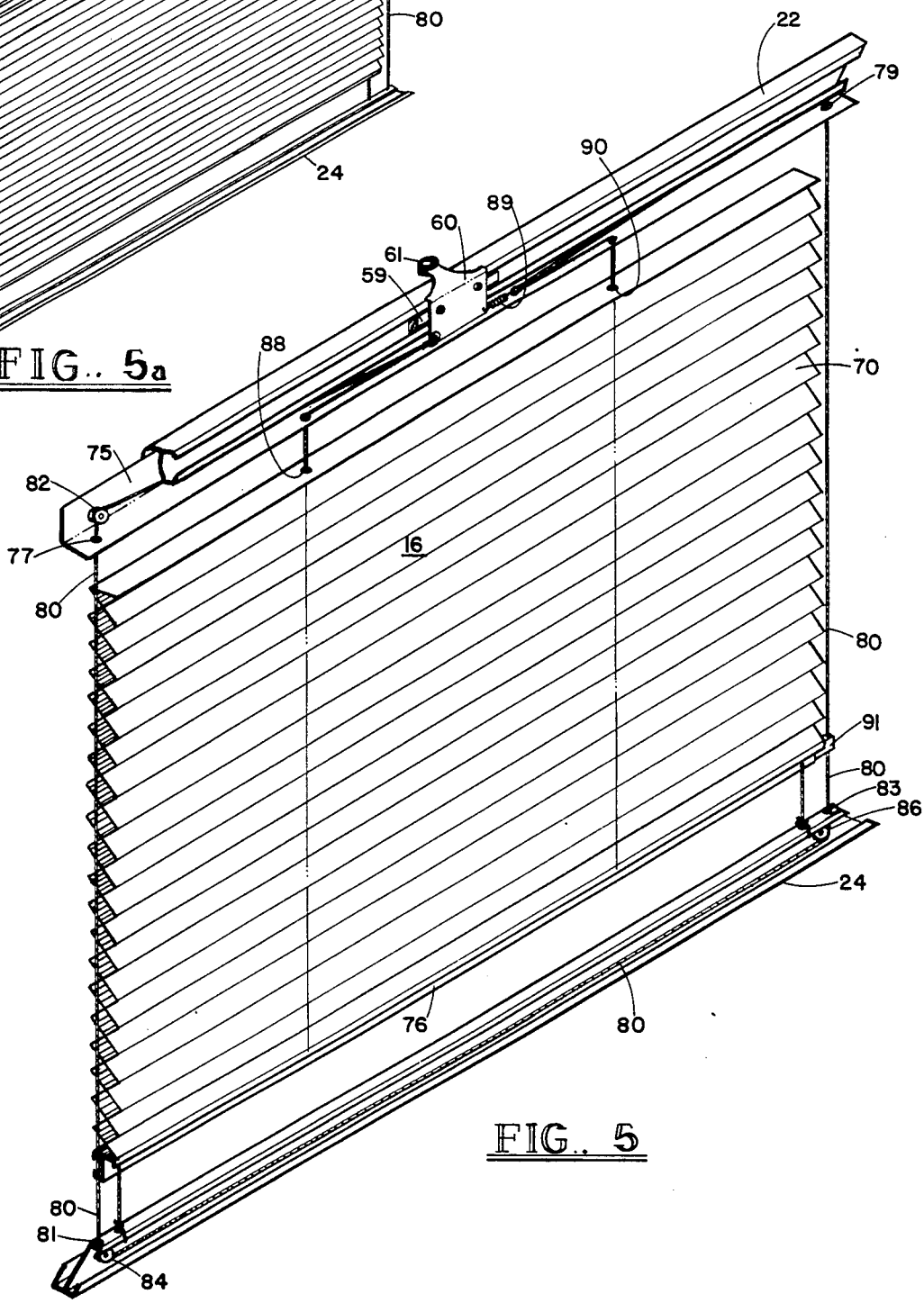
FIG. 5 is a perspective view of the collapsible double accordion window shade of the present invention showing details relating to the perimeter control mechanism.

Details relating to the collapsible double-accordion window shade assembly can be seen by referring to FIGS. 3 and 5. The shade is formed from a plurality of generally hexagonally-shaped tubes 70 of compressed polyester material with complementary opposing faces of adjacent tubes joined long a longitudinal seam 72. When the shade 16 is in the collapsed position, each of the tubular members 70 assumes a collapsed configuration as shown by the reference number **70*a* in FIG. 3. As the shade is moved to the open position, by the actuating mechanism, described in greater detail below, each of the tubular members 70 expands from the compressed configuration 70*a* to the fully extended position 70*b*. When the shade is fully extended, each of the tubes 70 contains a channel 74** of air. This channel of air is useful for providing both thermal and acoustical insulation for the passenger compartment.

The compressed polyester material used to form the collapsible shade 16 can be chosen in a wide variety of colors and optical densities, depending on the specific application. For example, certain applications may dictate the use of a semi-transparent or translucent material, while other applications may require a dark color with the polyester material having a very high optical density.

Referring to FIG. 5, the actuator system for moving the window shade 16 between the open and closed positions is seen to comprise a lever actuator 60 and an escapement mechanism including a cable 80 and a plurality of guide pulleys. As can be seen in FIG. 5, moving from the actuator 60 in a counter-clockwise direction, the cable 80 is routed over the upper right pulley 82 downward to the lower right pulley 84, then horizontally over left lower pulley 86, and finally, upward over the upper left pulley 88 and back to actuator 60. The cable is secured to the shade assembly by a locking plate 91 which is attached to the lower shade rail 76. A spring 89 is connected between the left side of the actuator 60 and the terminal end of the cable 80 to maintain proper tension in the cable. In an alternate embodiment of the invention, an electric or pneumatic actuator 60*a*, shown in FIG. 5*a* can be used to move the shade 16 between the open and closed positions.

With the window shade 16 in the fully closed position and having the orientation shown in FIGS. 1 and 2, the shade is lowered by moving the actuator to the left. As the actuator moves to the left, the cable 80 rotates in a counter-clockwise direction. The lower shade rail 76 being attached to the cable 80 by the locking plate 91 will follow the movement of the cable, thus lowering the shade assembly 16 until the lower shade rail 76 contacts the lower inner frame member 24.

Figure 5B:
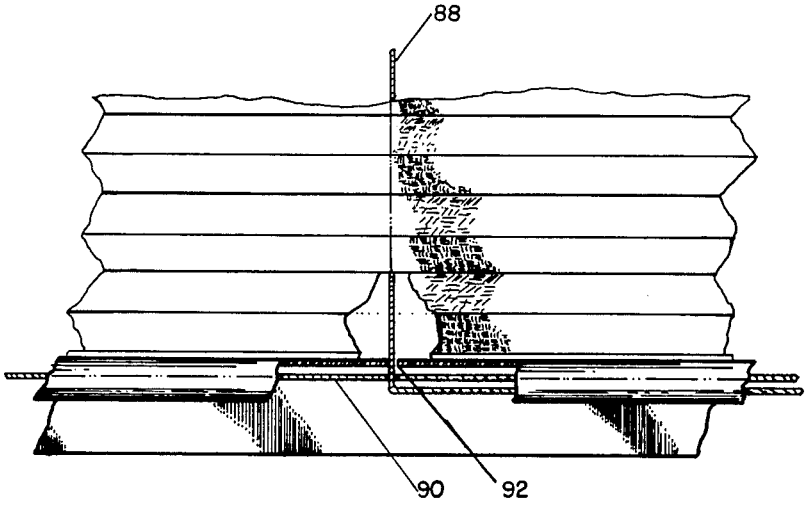
FIG. 5*b* is an elevational front view of the lower shade rail with a cutaway illustrating the alignment control mechanism with cables exploded away from lower shade rail.
Figure 5C:
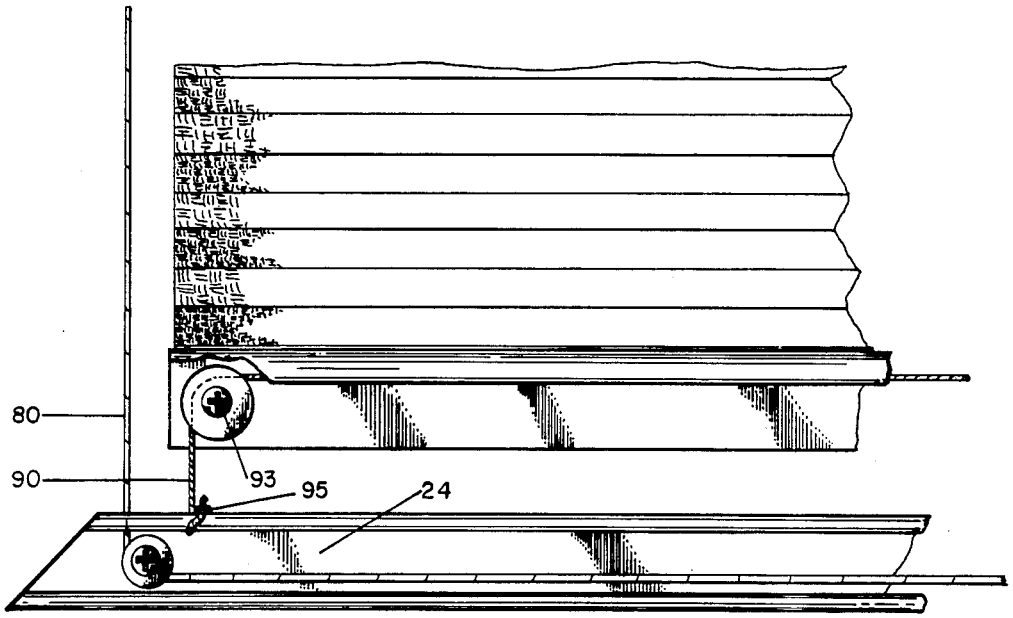
FIG. 5*c* is an elevational front view of the lower shade rail and the lower frame member showing the alignment control mechanism.

The cables 88 and 90, shown in FIG. 5, are provided as guides to eliminate vibration and to maintain proper alignment of the shade assembly during ascent and descent. The cables 88 and 90 are attached to the upper L-shaped support bracket 75 and are routed downward through apertures in the tubes 70 of the collapsible shade and through corresponding apertures in the lower shade rail 76. The cables are then directed over eyelet guides 92 and, then downward at 93 to points of attachment 95 with lower frame member 24 as is illustrated in FIGS. 5*b* and *c*.

Although the invention modular window insert has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A modular window insert unit comprising:

means defining a curved inner window pane formed of impact resistant plastic;

means defining a curved outer window pane formed of impact resistant plastic;

a curved frame assembly securing said inner and outer window panes in spaced, generally parallel relation;

collapsible shade means comprising a plurality of collapsible tubes formed from a compressed polymer material, said tubes being attached along complementary edges, each of said tubes being substantially collapsed when said shade is in a first position, and each of said tubes having a substantially hexagonal cross-section when said shade is in a second position, said shade being secured in said frame assembly between said inner and said outer panes;

actuator means for moving said collapsible shade from said first position to said second position.

2. A modular window insert according to claim 1, said frame assembly comprising a generally rectangular inner frame and outer frame defined by a molded outer faceplate, said outer faceplate comprising a bezel for securing said outer window pane to said frame assembly, said outer faceplate and said bezel being adapted to conform to the contour of an aircraft cabin, said inner frame and said outer frame being attached along complimentary outer peripheral edges, thereby defining a seal for preventing the entry of dust and other foreign matter into the interior of the window unit.

3. A modular window insert according to claim 1, said collapsible shade means having first and second ends, said first end attached to an edge of said curved frame assembly, said second end attached to a support rail, said collapsible shade means being extendible along a longitudinal axis from said first position to said second position, with a plurality of transverse air channels being defined by the interior of said collapsible tubes said collapsible shade means in said second position.

4. A modular window insert according to claim 3, said actuator means comprising a peripheral cable assembly slidably secured along the peripheral edges of said frame assembly and further secured to said support rail.

5. A modular window insert according to claim 4, said actuator means further comprising an electric motor for moving said cable assembly and thereby moving said shade from said first position to said second position.

6. A modular window insert according to claim 4, said actuator means further comprising a fluid cylinder means for moving said cable assembly and thereby moving said shade from said first position to said second position.

7. A modular window insert according to claim 1 further comprising an alignment maintenance means wherein said alignment maintenance means comprises a first cable and a second cable, said cables attached at a first end to an upper frame support member, said cables then depending downward perpendicular to the longitudinal axes of said tubes through apertures therein, through a lower shade rail with apertures therein, said lower shade rail having a bottom side, said cables then directed to opposite ends of said shade rail in a manner which criss-crosses said cables along said bottom side of said shade rail, said cables then directed downward to and rigidly attached under tension to a lower frame support member.

8. A modular window insert unit for use in the cabin of an aircraft or other vehicle, comprising:

a curved inner window pane;

a curved outer window pane;

a frame assembly for securing said inner and outer window panes in spaced relation with opposing faces of said inner and outer window panes being separated by a substantially uniform distance, said frame assembly comprising a generally rectangular inner frame and an outer frame defined by a molded outer faceplate, said outer faceplate having a bezel on an interior portion thereof for securing said outer window pane, said inner and outer frames being attached along complimentary peripheral edges, thereby defining a seal for preventing the entry of dust and other foreign material into the interior of the window unit;

a generally rectangular mask secured within said frame assembly between said inner and outer window panes;

a collapsible shade means secured within said frame assembly between said inner and outer window panes, said shade comprising a plurality of collapsible tubular members, said shade extendible between a first position wherein said tubular members are collapsed and a second position wherein said tubular members define a plurality of transverse channels of air contained within said shade;

actuator means for moving said shade between said first position and said second position.

* * * * *